US007448708B2

(12) United States Patent
Nakayama

(10) Patent No.: US 7,448,708 B2
(45) Date of Patent: Nov. 11, 2008

(54) LIQUID DROPLET EJECTING HEAD, IMAGE RECORDING APPARATUS, RECORDING METHOD, AND IMAGE RECORDING METHOD WITH DIGITAL SIGNALS EXPRESSING VOLTAGE AND DURATION OF A WAVEFORM

(75) Inventor: Kota Nakayama, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 506 days.

(21) Appl. No.: 11/211,313

(22) Filed: Aug. 25, 2005

(65) Prior Publication Data

US 2006/0176328 A1 Aug. 10, 2006

(30) Foreign Application Priority Data

Feb. 10, 2005 (JP) ..... 2005-035002

(51) Int. Cl.
*B41J 29/38* (2006.01)
*B41J 2/05* (2006.01)

(52) U.S. Cl. ..... 347/10; 347/11; 347/57

(58) Field of Classification Search ..... 347/10, 347/9, 5, 15, 14, 12, 13, 11, 57; 358/1.16, 358/3.23, 426.02
See application file for complete search history.

(56) References Cited

U.S. PATENT DOCUMENTS 5,486,848 A * 1/1996 Ayata et al. ..... 347/15
5,557,304 A * 9/1996 Stortz ..... 347/15
6,027,195 A * 2/2000 Gauthier et al. ..... 347/5
6,139,126 A * 10/2000 Ayata et al. ..... 347/13
6,145,946 A * 11/2000 Gauthier et al. ..... 347/5
6,264,297 B1 * 7/2001 Ayata et al. ..... 347/12
6,431,676 B2 * 8/2002 Asauchi et al. ..... 347/10
6,779,863 B2 * 8/2004 Usuda ..... 347/14
6,866,356 B2 * 3/2005 Usuda et al. ..... 347/9
7,237,859 B2 * 7/2007 Usuda ..... 347/9
7,293,851 B2 * 11/2007 Nakayama ..... 347/10
7,320,509 B2 * 1/2008 Kobayashi et al. ..... 347/10

FOREIGN PATENT DOCUMENTS

JP 7-241992 9/1995

* cited by examiner

*Primary Examiner*—Stephen D Meier
*Assistant Examiner*—Rene Garcia, Jr.
(74) *Attorney, Agent, or Firm*—Fildes & Outland, P.C.

(57) ABSTRACT

A liquid droplet ejecting head has a nozzle, a driving element which ejects a liquid droplet from the nozzle by being driven, a storing unit, a driving waveform generating unit, and a supplying unit. The storing unit respectively stores plural driving waveforms, which are for timewise driving a driving element in accordance with an amount of a liquid droplet, as plural digital signals each converted into binary numbers expressing a voltage level of the driving waveform and a duration period of the voltage level. The driving waveform generating unit generates plural driving waveforms on the basis of the plural digital signals. On the basis of image data, the supplying unit selects a driving waveform to be supplied to the driving element from among the plural driving waveforms, and supplies a selected driving waveform to the driving element.

16 Claims, 9 Drawing Sheets

COMPRESSED DRIVING DATA : 1000101000010100100001000000100011111111

IMAGE DATA
COMPRESSED DRIVING DATA (SERIAL INPUT)
24
26
28
30
30A
30B
30C
30D
32A
32B
32C
32D
34A
34B
34C
34D
36A
36B
36C
36D
38
40
42
44₁
44₂
44₃
46
48
49
20₁
20₂
20₃
90
92
94
96

LIQUID DROPLET EJECTING HEAD, IMAGE RECORDING APPARATUS, RECORDING METHOD, AND IMAGE RECORDING METHOD WITH DIGITAL SIGNALS EXPRESSING VOLTAGE AND DURATION OF A WAVEFORM

CROSS-REFERENCE TO RELATED APPLICATION

This application claims priority under 35 USC 119 from Japanese Patent Application No. 2005-35002, the disclosure of which is incorporated by reference herein.

BACKGROUND OF THE INVENTION

1. Field of the Invention

The present invention relates to a liquid droplet ejecting head, an image recording apparatus, a recording method, and an image recording method, and in particular, to a liquid droplet ejecting head, image recording apparatus, recording method and image recording method equipped with a driving element which causes a liquid droplet to be ejected from a corresponding nozzle by being driven in accordance with a driving waveform supplied thereto.

2. Description of the Related Art

As conventional image recording apparatuses, there are known image recording apparatuses such as inkjet recording apparatuses and the like which record dots corresponding to respective pixels of image data by ejecting liquid droplets of ink or the like from plural nozzles.

In such an image recording apparatus, the displacement of a driving element, which arises due to a driving waveform, which is for timewise driving a driving element such as a piezo element or the like in accordance with the amount of an ink droplet, being supplied to the driving element, is transferred via a vibrating plate to a pressure chamber filled with ink. An ink droplet is thereby ejected from the nozzle due to the fluctuations in pressure within the pressure chamber. By using such a piezo method, an ink droplet which corresponds to image data is ejected from a nozzle such that a dot is recorded.

In order to obtain good image quality, good ink eject at all of the nozzles is desirable. However, in actuality, from the standpoints of machining accuracy and costs, it is difficult to carry out good ink eject at all of the nozzles, and there are cases in which dispersion arises in the amounts of ink ejected from the respective nozzles. Further, when the characteristics of the ink vary due to changes in the environment such as the temperature and the humidity or the like, even if the same driving waveform is supplied to the driving elements, dispersion may arise in the amounts of the ink droplets which are ejected.

In order to correct such dispersion in the amounts of ink droplets which are expelled, there is known a method of correcting the driving waveform in accordance with the environmental changes and the characteristics of the nozzles (see, for example, Japanese Patent Application Laid-Open (JP-A) No. 7-241992).

In the technique disclosed in JP-A No. 7-241992, plural heat pulses and plural pre-heat pulses are supplied as a driving waveform to a base for a recording head. At this time, the plural heat pulses and the plural pre-heat pulses are supplied, by dedicated signal lines respectively, to the base via plural corresponding input terminals provided at the substrate. At the base for the inkjet recording head, one of the heat pulses and one of the pre-heat pulses are selected from among the supplied plural heat pulses and plural pre-heat pulses, and are supplied to the corresponding driving element. By applying this technique, the dispersion in the ink droplet amounts can be corrected if a driving waveform corresponding to the environmental temperature and humidity is supplied to the base for the recording head.

However, in the above-described technique, in order to supply each of plural driving waveforms to the liquid droplet ejecting head which serves as the recording head, a number of dedicated signal lines, which number corresponds to the number of driving waveforms, must be provided, and there are the problems that the structure becomes complex, and the liquid droplet ejecting head and the image recording apparatus become large. Further, in recent years, liquid droplet ejecting heads have become known which are structured such that a liquid droplet ejecting head, in which plural driving elements are lined-up in a row, is considered as one unit, and plural these unit liquid droplet ejecting heads are lined-up. In such a technique, there is the concern that the increase in the number of signal wires in particular will become problematic.

A method of serially supplying plural driving waveforms to the liquid droplet ejecting head by one signal wire has been thought of. However, because image recording apparatuses are becoming more high-speed, there are cases in which the time for supplying the driving waveforms becomes problematic.

SUMMARY OF THE INVENTION

The present invention was developed in order to address the above-described problems, and provides a liquid droplet ejecting head and an image recording apparatus which can efficiently supply plural driving waveforms to a liquid droplet ejecting head, and can keep the liquid droplet ejecting head and the image recording apparatus from becoming large.

A first aspect of the present invention is a liquid droplet ejecting head comprising: a nozzle; a driving element driving the nozzle and causing a liquid droplet to be ejected from the nozzle; a storing unit respectively storing plural driving waveforms, which are for timewise driving the driving element in accordance with an amount of a liquid droplet, as plural binary digital signals each expressing a voltage level of the driving waveform and a duration time of the voltage level; a driving waveform generating unit generating plural driving waveforms on the basis of the plural digital signals stored in the storing unit; and a supplying unit which, on the basis of image data, selects a driving waveform to be supplied to the driving element from the plural driving waveforms generated by the driving waveform generating unit, and supplies a selected driving waveform to the driving element.

BRIEF DESCRIPTION OF THE DRAWINGS

Preferred embodiments of the present invention will be described in detail based on the following figures, wherein.

DETAILED DESCRIPTION OF THE INVENTION

Hereinafter, an embodiment of the present invention will be described in detail with reference to the drawings.

Figure 1:
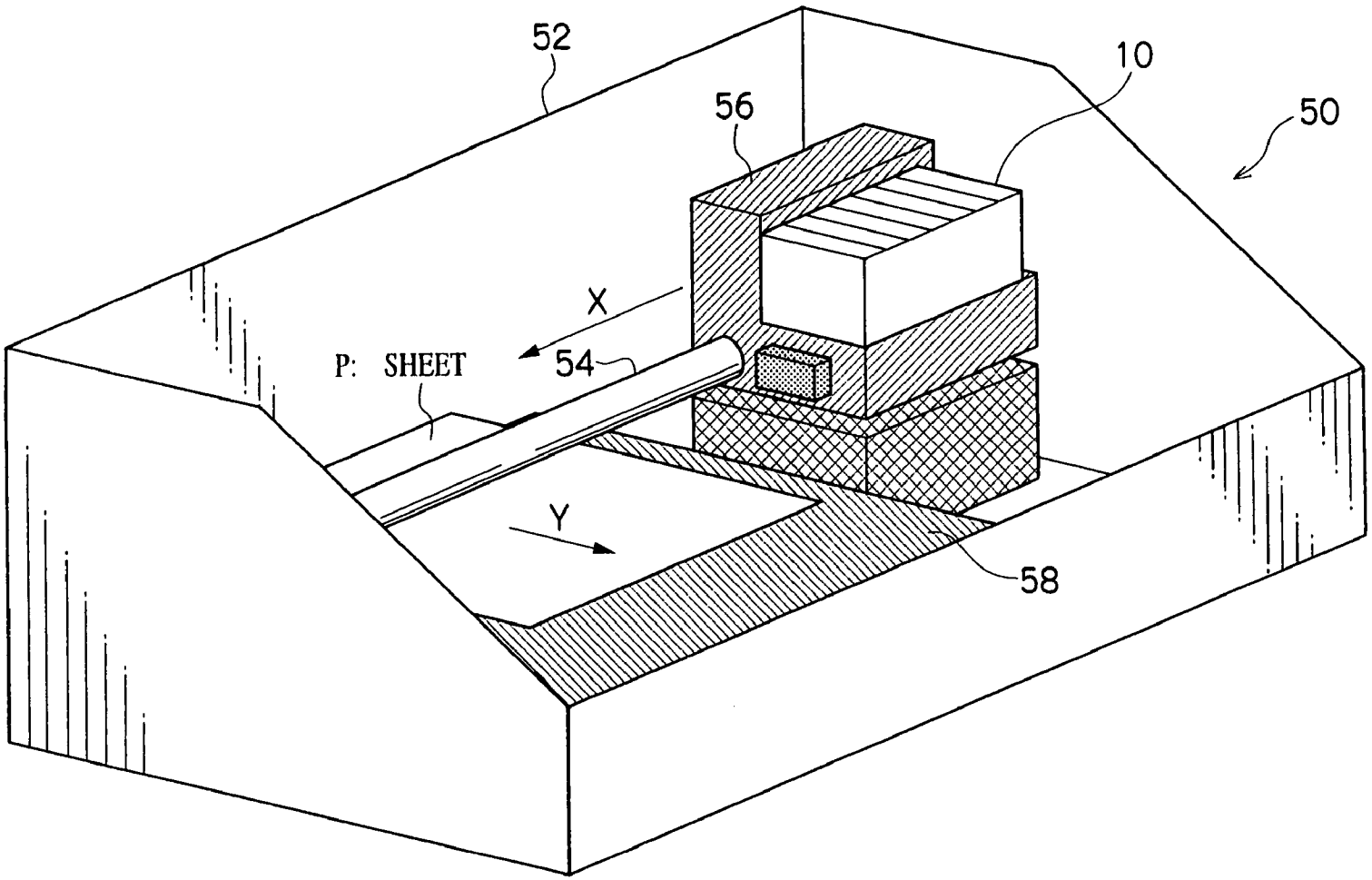
FIG. 1 is a structural diagram showing the basics of an image recording apparatus relating to an embodiment.

As shown in FIG. 1, a rod 54 which is provided at a housing 52, and a carriage 56 which moves along the rod 54, are provided at an image recording apparatus 50 relating to the present embodiment. A recording head 10 for recording images is detachably mounted on the carriage 56. Recording in a main scanning direction X is carried out by ink being ejected while the carriage 56 is moved along the rod 54.

A platen 58, for placement of a sheet P serving as a printing medium, is provided at the image recording apparatus 50. Due to the sheet P moving on the platen 58 in a direction intersecting the moving direction of the carriage 56, recording in a subscanning direction Y is carried out.

Namely, while the carriage 56 is scanned in the main scanning direction along the rod 54, an image is formed in the main scanning direction by ink droplets being ejected from the recording head 10 which is carried on the carriage 56. By repeatedly carrying out image forming in the main scanning direction and sheet feeding in the subscanning direction, an image is formed on the entire surface of the sheet P.

Figure 2:
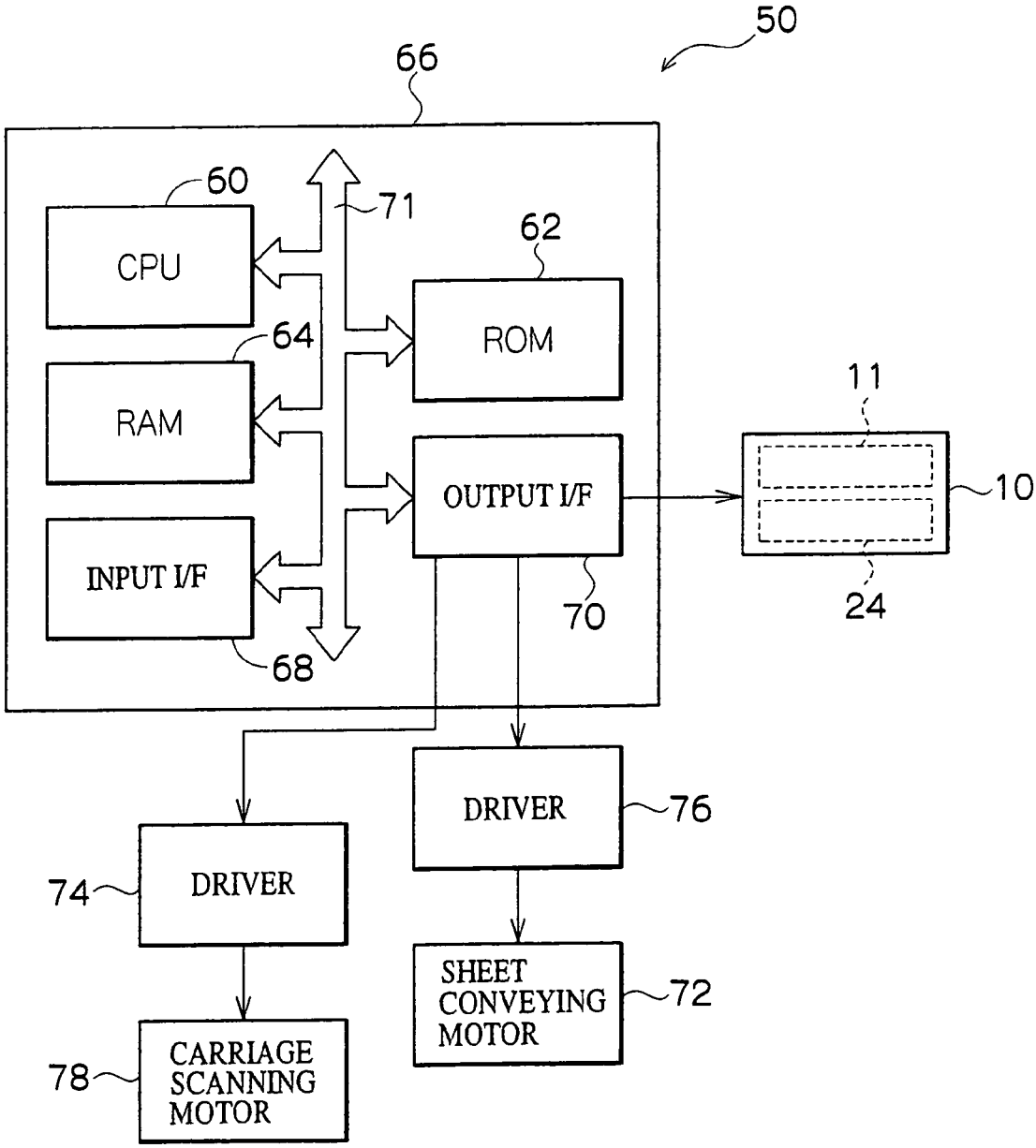
FIG. 2 is a block diagram showing the electrical structure of the image recording apparatus relating to the embodiment.

As shown in FIG. 2, the image recording apparatus 50 is operated and controlled by a microcomputer 66 having a CPU 60, a ROM 62, a RAM 64 and peripheral devices. The microcomputer 66 is structured by the CPU 60, the ROM 62, the RAM 64, an input interface (input I/F) 68, and an output interface (output I/F) 70 being connected by a bus 71. Various data, such as image data and the like, and commands are inputted to the input I/F 68 from other devices.

A driver 76, which drives a sheet conveying motor 72 for conveying the sheet P in the subscanning direction, and a driver 74, which drives a carriage scanning motor 78 for moving the carriage 56, are connected to the output I/F 70. The sheet conveying motor 72 and the carriage scanning motor 78 are controlled in accordance with instructions of the microcomputer 66.

The recording head 10 is connected to the output I/F 70. The recording head 10 is structured to include an ink droplet ejecting section 11 for ejecting ink droplets, and a head driving section 24 for driving the ink droplet ejecting section 11 to eject ink droplets.

Figure 3:
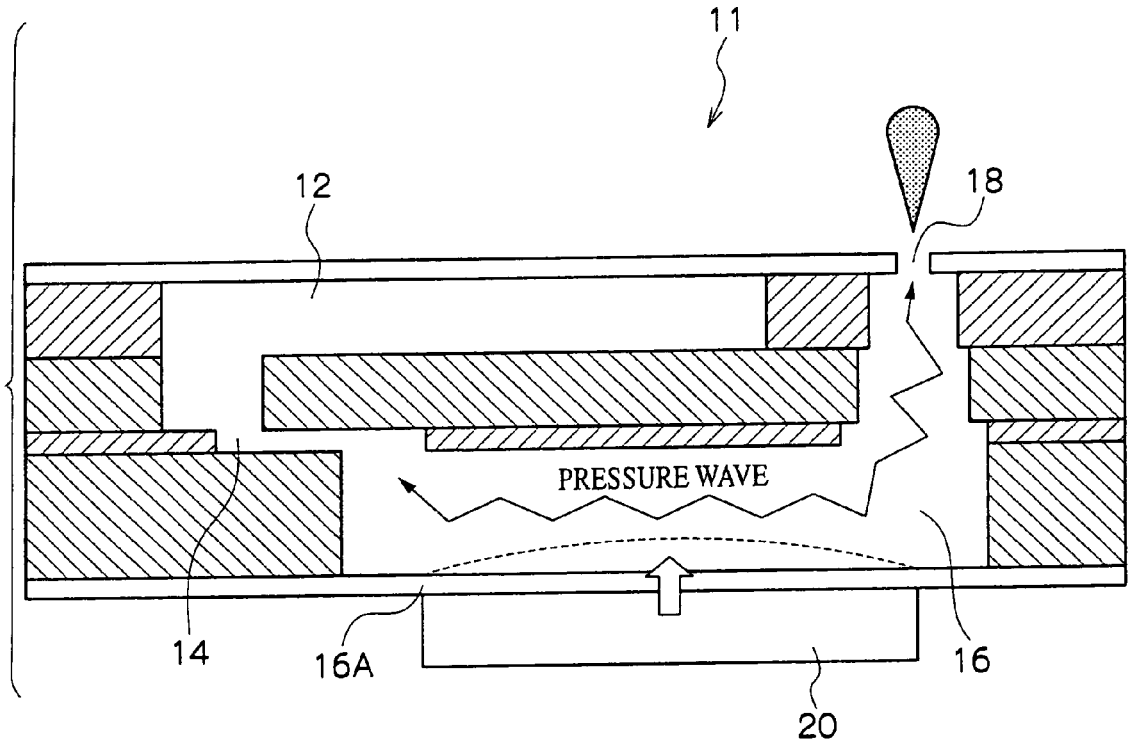
FIG. 3 is a cross-sectional view showing the internal structure of an ink droplet ejecting section relating to the embodiment.

Plural nozzles and plural ink tanks are provided at the ink droplet ejecting section 11. As shown in FIG. 3, ink, which is supplied via an ink supply path (not shown) is stored in each ink tank 12. The ink tank 12 communicates with a pressure chamber 16 via a supply path 14. The pressure chamber 16 is filled with ink which is supplied from the ink tank 12 via the supply path 14. A portion of the wall surfaces of the pressure chamber 16 is structured by a vibrating plate 16A. A piezo element 20, which serves as a driving element relating to the present invention, is joined to the vibrating plate 16A. When voltage is applied to the piezo element 20 in accordance with a driving waveform which will be described later, due the piezo element 20 being displaced, the vibrating plate 16A vibrates, and the vibration of the vibrating plate 16A propagates within the pressure chamber 16 as a pressure wave. The ink within the pressure chamber 16 is thereby ejected as an ink droplet via a nozzle 18 which communicates with the pressure chamber 16.

Figure 5:
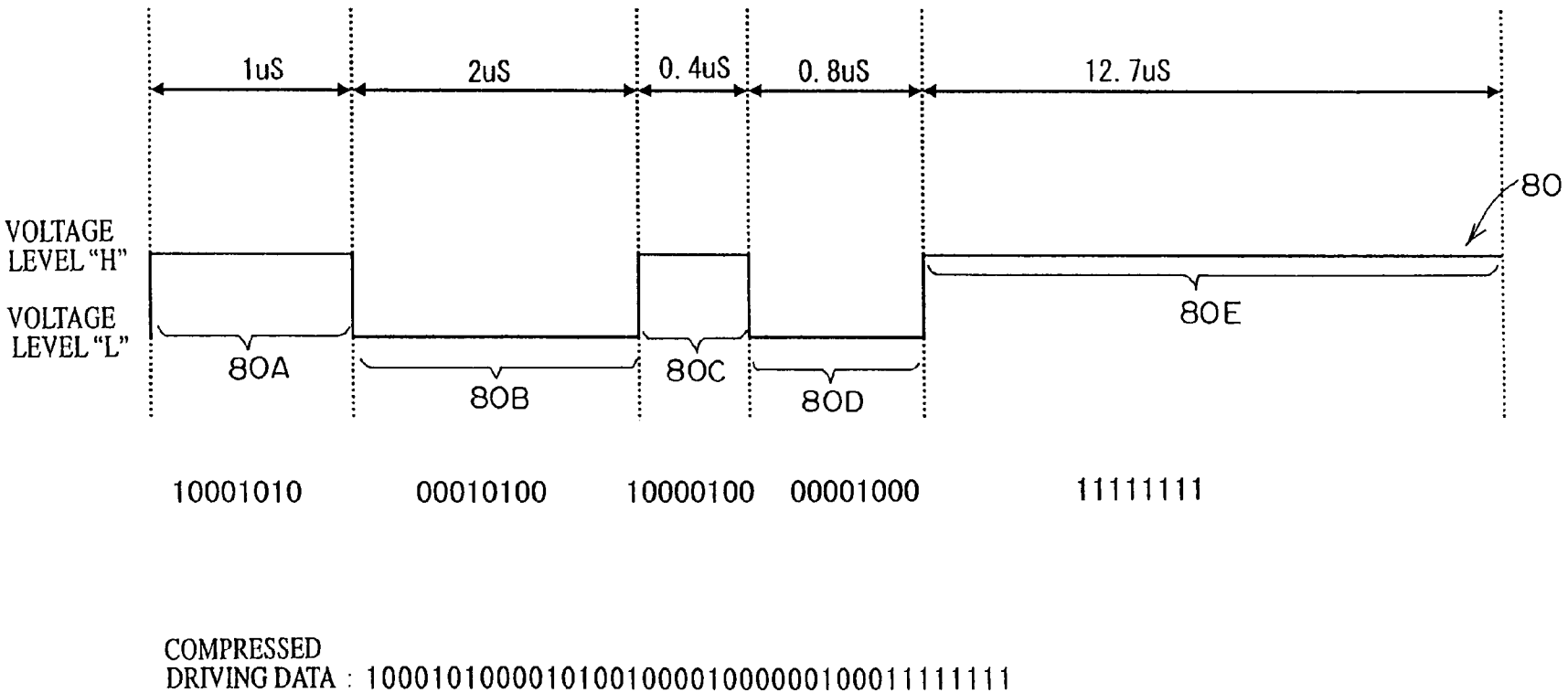
FIG. 5 is a schematic diagram showing a driving waveform and compressed driving data.

For example, as shown in FIG. 5, the driving waveform is a driving waveform 80 whose voltage level is expressed by two states which are a high level state and a low level state. By supplying this driving waveform 80 to the piezo element 20, when the voltage level is in the high level state, the piezo element 20 is displaced in accordance with the voltage level and propagates the pressure wave within the pressure chamber 16, and when the voltage level is in the low level state, the piezo element 20 returns to its state before displacement and does not propagate the pressure wave in the pressure chamber 16.

The liquid droplet amount of the ink droplet which is ejected from each nozzle of the ink droplet ejecting section 11 depends on the driving waveform which is applied to the corresponding piezo element 20. The size of the dot, which is formed on the recording medium by the ink droplet ejected from the nozzle 18, depends on the liquid droplet amount of the ink droplet ejected from that nozzle 18. Therefore, by switching the liquid droplet amount of the ink droplet in accordance with the driving waveform, the size of the dot formed on the recording medium by the ink droplet ejected from the nozzle 18 can be adjusted per nozzle 18 (piezo element 20).

Figure 4:
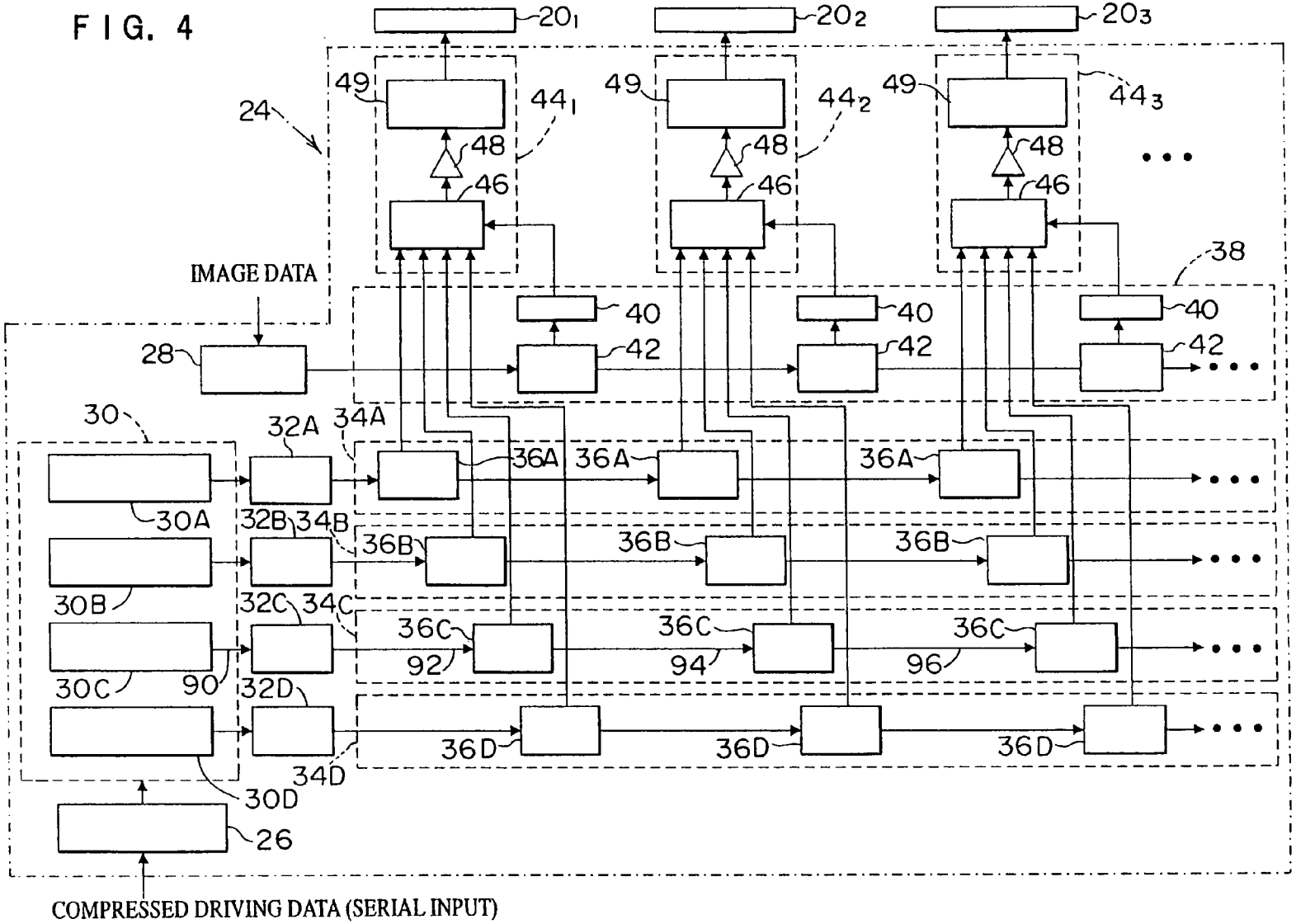
FIG. 4 is a block diagram showing the schematic structure of a head driving section relating to the embodiment.

As shown in FIG. 4, the head driving section 24 is structured so as to include a compressed driving data input circuit 26, a memory 30, decompressing circuits 32A, 32B, 32C, and 32D, shift register groups 34A, 34B, 34C, and 34D, a selection data input circuit 28, a data transferring/inputting section (shift register array) 38, and driving signal voltage generating sections 44.

In order to eject, from the respective nozzles 18, ink droplets of a relatively large liquid droplet amount (hereinafter called "large droplets"), ink droplets of a liquid droplet amount smaller than the large droplets (hereinafter called "medium droplets"), and ink droplets of a liquid droplet amount smaller than the medium droplets (hereinafter called "small droplets"), respective compressed driving data for a large droplet, for a medium droplet, and for a small droplet, which are generated on the basis of driving waveforms to be applied to the piezo elements 20 corresponding to the respective nozzles 18 and which will be described in detail later, are stored in advance in the memory 30. In order to propagate a pressure wave within the pressure chamber 16 to the extent that an ink droplet is not ejected from the nozzle 18, compressed driving data for non-eject, which is generated on the basis of a driving waveform for non-eject for application to the piezo elements 20 and which will be described in detail later, is stored in advance in the memory 30.

As shown in FIG. 5, the compressed driving data is a digital signal which binarily expresses the voltage level of each time period (hereinafter called "window") between a time of change and a time of change of the voltage level of the driving waveform, and the duration period of each window. Note that, in the present embodiment, the converting of a driving waveform into such a digital signal (compressed driving data) expressed by binary numbers is called "compression", and the generating of a driving waveform based on a digital signal (compressed driving data) is called "decompression".

In the present embodiment, 8-bit data is used as the digital data expressing each window. The leading bit of the 8-bit data is a bit expressing the voltage level, and the bits from the second through eighth bits are bits for expressing, by binary numbers, the duration period of the window. When the voltage level of a window is "H", the value of the leading bit is "1". When the voltage level of a window is "L", the value of the leading bit is "0".

Specifically, as shown in FIG. 5, the driving waveform 80 includes five windows 80A, 80B, 80C, 80D, and 80E. The voltage levels of the window 80A, the window 80C, and the window 80E are "H", and the voltage levels of the window 80B and the window 80D are "L". A case is assumed in which the duration period of the window 80A is 1 μS, the duration period of the window 80B is 2 μS, the duration period of the window 80C is 0.4 μS, the duration period of the window 80D is 0.8 μS, and the duration period of the window 80E is 12.7 μS. In this case, when the clock frequency is 10 MHZ, because the voltage level of the window 80A is "H" and the duration period thereof is 1 μS, the leading bit is "1", and the second through eighth bits are "0001010" because the duration period is 1 μS. Accordingly, the window 80A is expressed by compressed data "10001010". Similarly, the window 80B is expressed by compressed data "00010100", and the window 80C is expressed by compressed data "10000100". Further, the window 80D is expressed by compressed data "00001000", and the window 80E is expressed by compressed data "11111111".

Accordingly, by converting, i.e., compressing, the driving waveform 80 into digital data expressed by two values, it is converted into "1000101000010100100001000000100011111111" as compressed driving data which makes the respective compressed data for the windows 80A, 80B, 80C, 80D and 80E continuous in time series order.

This compressed driving data is generated by the microcomputer 66 for a large droplet, for a medium droplet, for a small droplet, and for non-eject, respectively. The prepared driving compression data for a large droplet, for a medium droplet, for a small droplet, and for non-eject are serially connected in the order of the compressed driving data for a large droplet, the compressed driving data for a medium droplet, the compressed driving data for a small droplet, and the compressed driving data for non-eject, and are successively inputted to the head driving section 24 as a compressed driving data string. At the head driving section 24, when the compressed driving data string is inputted via the compressed driving data input circuit 26, the compressed driving data for a large droplet, for a medium droplet, for a small droplet, and for non-eject, respectively, of the inputted compressed driving data string are stored in the memory 30.

Figure 9:
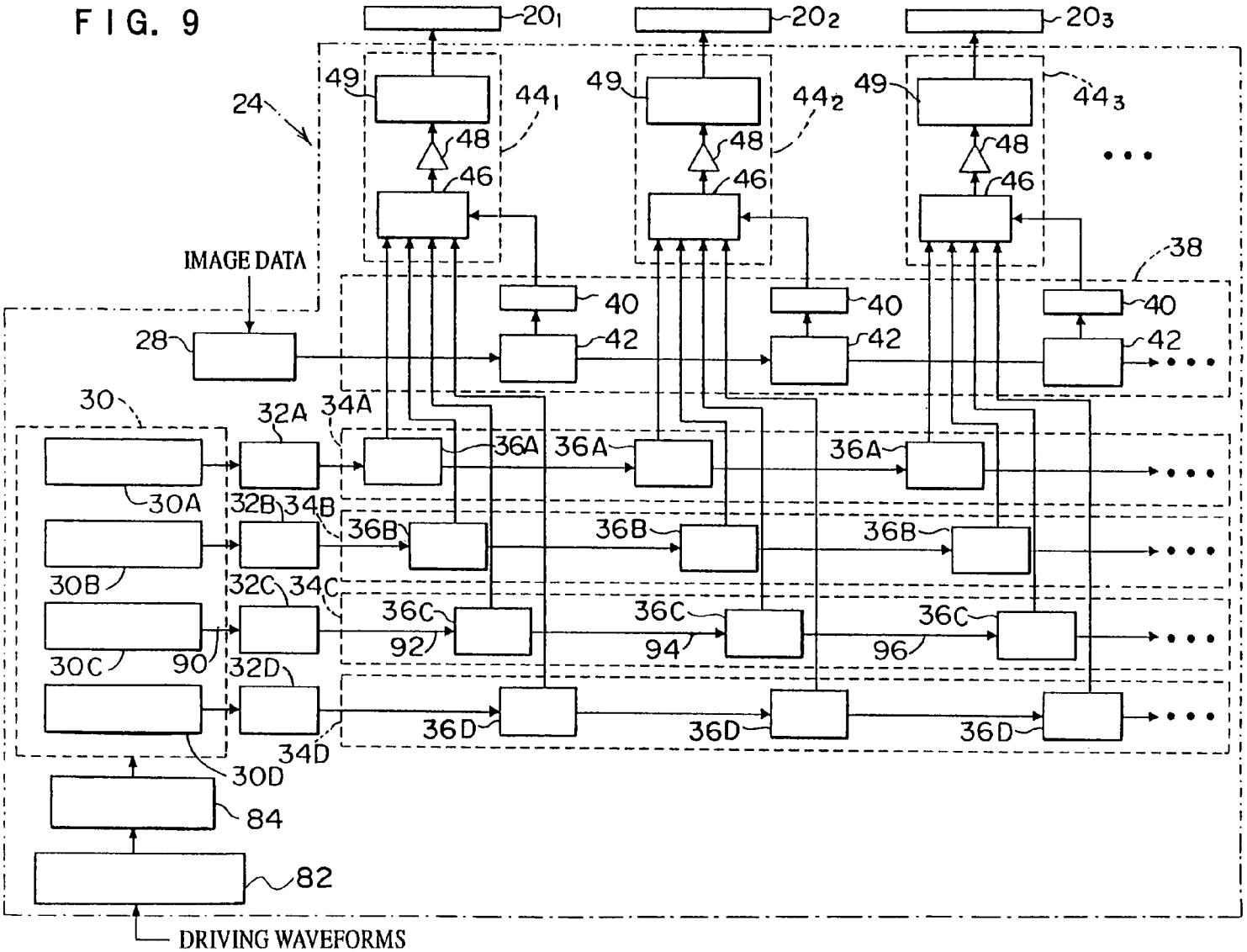
FIG. 9 is a cross-sectional view showing the internal structure of the ink droplet ejecting section relating to the embodiment.

Note that, as shown in FIG. 9, the head driving section 24 may be structured so as to include a driving waveform input circuit 82 and a converting circuit 84. In this case, a driving waveform is inputted via the driving waveform input circuit 82, and the inputted driving waveform is converted into compressed driving data at the converting circuit 84, and the compressed driving data is stored in the memory 30.

The memory 30 is structured to include a compressed driving data for a large droplet memory 30A for storing the compressed driving data for a large droplet, a compressed driving data for a medium droplet memory 30B for storing the compressed driving data for a medium droplet, a compressed driving data for a small droplet memory 30C for storing the compressed driving data for a small droplet, and a compressed driving data for non-eject memory 30D for storing the compressed driving data for non-eject. Each of the compressed driving data for a large droplet memory 30A, the compressed driving data for a medium droplet memory 30B, the compressed driving data for a small droplet memory 30C, and the compressed driving data for non-eject memory 30D reads-out and outputs, one bit-by-one bit, the stored compressed driving data at a timing which is synchronous with a predetermined clock signal.

The input ends of the decompressing circuit 32A, the decompressing circuit 32B, the decompressing circuit 32C, and the decompressing circuit 32D are respectively connected to the output ends of the compressed driving data for a large droplet memory 30A, the compressed driving data for a medium droplet memory 30B, the compressed driving data for a small droplet memory 30C, and the compressed driving data for non-eject memory 30D. The output ends of the decompressing circuit 32A, the decompressing circuit 32B, the decompressing circuit 32C, and the decompressing circuit 32D are respectively connected to the input ends of the shift register groups 34A, 34B, 34C, and 34D.

The compressed driving data outputted from the compressed driving data for a large droplet memory 30A, the compressed driving data for a medium droplet memory 30B, the compressed driving data for a small droplet memory 30C, and the compressed driving data for non-eject memory 30D, are respectively decompressed into driving waveforms for a large droplet, for a medium droplet, for a small droplet, and for non-eject by the decompressing circuit 32A, the decompressing circuit 32B, the decompressing circuit 32C, and the decompressing circuit 32D, and are outputted to the corresponding shift register groups 34A, 34B, 34C, and 34D.

The shift register groups 34A, 34B, 34C, and 34D are structured by plural shift registers 36A, plural shift registers 36B, plural shift registers 36C, and plural shift registers 36D being connected in series, respectively. Note that the plural shift registers 36A, the plural shift registers 36B, the plural shift registers 36C, and the plural shift registers 36D are provided so as to respectively correspond to the plural driving signal voltage generating sections 44 which are provided so as to correspond to the plural piezo elements $\mathbf{20}_{1\sim n}$.

When the driving waveforms for a large droplet, for a medium droplet, for a small droplet, and for non-eject are inputted to the shift register groups 34A, 34B, 34C, and 34D respectively, the driving waveforms are successively transferred to the plural shift registers 36A, the plural shift registers 36B, the plural shift registers 36C, and the plural shift registers 36D at the respective shift register groups 34A, 34B, 34C, and 34D at periods which are synchronous with predetermined clock signals. The output ends of the plural shift registers 36A, the plural shift registers 36B, the plural shift registers 36C, and the plural shift registers 36D are connected to the input ends of selectors 46, which will be described later, of the corresponding driving signal voltage generating sections 44. The driving waveforms, which are transferred to the plural shift registers 36A, the plural shift registers 36B, the plural shift registers 36C, and the plural shift registers 36D, are outputted to the corresponding driving signal voltage generating sections 44.

Therefore, the driving waveforms for a large droplet, for a medium droplet, for a small droplet, and for non-eject are inputted to each of the driving signal voltage generating sections 44.

Here, image data is inputted to the selection data inputting circuit 28 from the microcomputer 66. On the basis of the inputted image data, the selection data inputting circuit 28 determines the absence/presence of ejecting of an ink droplet (i.e., whether or not eject is to be carried out) and the liquid droplet amount (a large droplet, a medium droplet, or a small droplet) of the ink droplet to be ejected, from each of the nozzles 18. On the basis of these results of determination, for each of the driving signal voltage generating sections 44 which are provided in correspondence with the piezo elements $20_{1\sim n}$, the selection data inputting circuit 28 generates selection data for instructing which driving waveform among the driving waveforms for a large droplet, for a medium droplet, for a small droplet, and for non-eject is to be selected. The selection data inputting circuit 28 successively outputs the generated selection data.

The output end of the selection data inputting circuit 28 is connected to the input end of the data transferring/inputting section 38. The data transferring/inputting section 38 is provided so as to correspond to the respective driving signal voltage generating sections 44, and is structured such that plural shift registers 42, which are for successively transferring the selection data outputted successively from the selection data inputting circuit 28, are connected in series. Further, the data transferring/inputting section 38 is structured to include plural latches 40, which are provided in correspondence with the plural shift registers 42, and which hold the selection data outputted from the shift registers 42, and which are for outputting the selection data to the corresponding driving signal voltage generating sections 44. The selection data, which is generated by and outputted from the selection data inputting circuit 28 for each of the driving signal voltage generating sections 44, is outputted to the corresponding driving signal voltage generating sections 44 via the data transferring/inputting section 38.

Each of the driving signal voltage generating sections 44 is structured so as to include: the selector 46 to which the driving waveforms for a large droplet, for a medium droplet, for a small droplet, and for non-eject are inputted, and to which the selection data is inputted, and which selects one of the inputted driving waveforms on the basis of the selection data; a voltage boosting circuit 48 for boosting the driving waveform selected by the selector 46 to a predetermined voltage level, and outputting it; and a driver circuit 49 for outputting, to the corresponding piezo element $20_{1\sim n}$, voltage corresponding to the driving waveform inputted from the voltage boosting circuit 48.

The input ends of the selector 46 are connected to the output end of the corresponding latch 40, and the output ends of the corresponding shift registers 36A, 36B,. 36C and 36D. The input end of the voltage boosting circuit 48 is connected to the output end of the selector 46. The output end of the voltage boosting circuit 48 is connected to the input end of the driver circuit 49. The output end of the driver circuit 49 is connected to the corresponding piezo element $20_{1\sim n}$.

One driving waveform, among the inputted driving waveforms for a large droplet, for a medium droplet, for a small droplet, and for non-eject, is selected by the selector 46 on the basis of the inputted selection data. Due to voltage, which corresponds to the selected driving waveform, being applied to the corresponding piezo element $20_{1\sim n}$, eject of a large droplet, a medium droplet, or a small droplet, or non-eject, from the corresponding nozzle 18 is carried out.

Next, operation of the present embodiment will be described.

Figure 6:
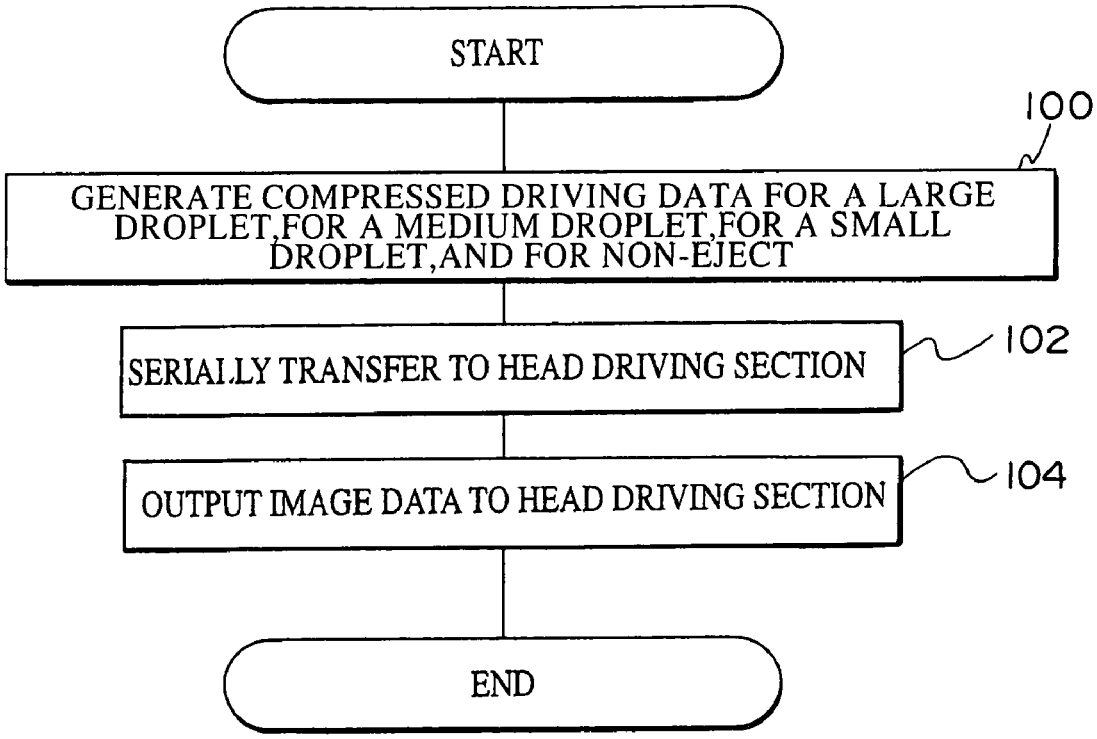
FIG. 6 is a flowchart showing processings executed at a microcomputer of the image recording apparatus.

When electric power is supplied to the image recording apparatus 50 due to a power source switch (not illustrated) of the inkjet recording apparatus being operated, the processing routine shown in FIG. 6 is executed at the CPU 60, and proceeds to step 100 where compressed driving data for a large droplet, for a medium droplet, for a small droplet, and for non-eject are respectively generated in accordance with the respective driving waveforms for a large droplet, for a medium droplet, for a small droplet, and for non-eject.

The driving waveforms for a large droplet, for a medium droplet, for a small droplet, and for non-eject may be inputted from the exterior, or may be stored in advance in the RAM 64 and read-out from the RAM 64.

In subsequent step 102, the compressed driving data for a large droplet, for a medium droplet, for a small droplet, and for non-eject, which were generated in above step 100, are serially transferred to the head driving section 24 as a compressed driving data string serially connected in the order of the compressed driving data for a large droplet, the compressed driving data for a medium droplet, the compressed driving data for a small droplet, and the compressed driving data for non-eject.

In next step 104, the image data of the image to be recorded is outputted to the head driving section 24, and thereafter, the present routine ends.

In the present embodiment, description is given of a case in which the compressed driving data string is serially transferred to the head driving section 24 before the image data is outputted to the head driving section 24. However, it suffices for the timing of the transfer of the compressed driving data to be at a time of non-eject of ink droplets from the nozzles 18, and is not limited to this timing.

Next, the processing carried out at the head driving section 24 will be described.

Figure 7:
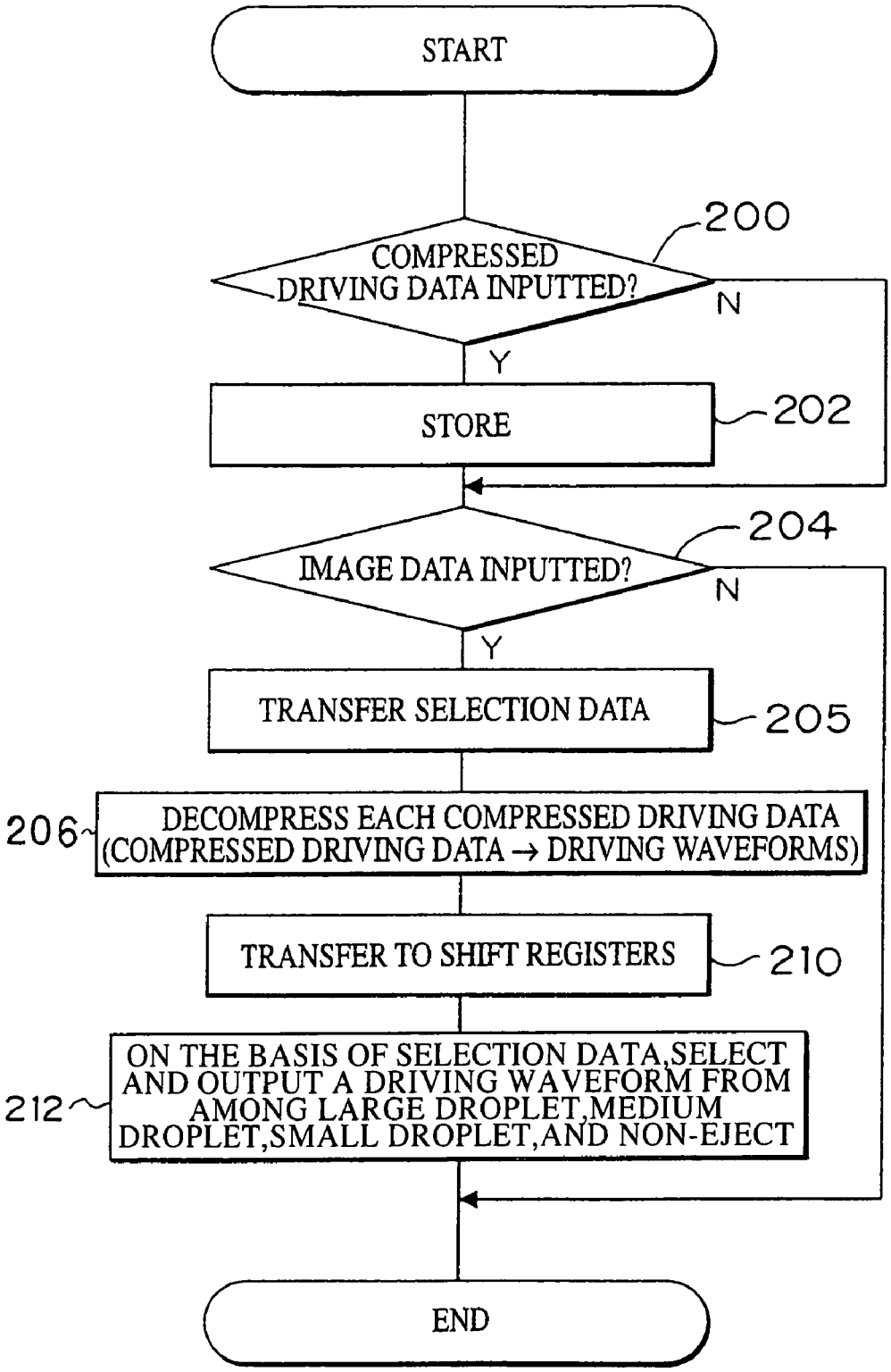
FIG. 7 is a flowchart showing processings executed at the head driving section.

Each predetermined period of time, the head driving section 24 executes the processing routine shown in FIG. 7, and the routine proceeds to step 200. When the compressed driving data string is serially inputted from the microcomputer 66, the routine proceeds to step 202 where the compressed driving data for a large droplet, for a medium droplet, for a small droplet, and for non-eject, which are included in the inputted compressed driving data string, are respectively stored in the corresponding compressed driving data for a large droplet memory 30A, compressed driving data for a medium droplet memory 30B, compressed driving data for a small droplet memory 30C, and compressed driving data for non-eject memory 30D.

In next step 204, when the image data is inputted from the microcomputer 66, the routine moves on to step 205, whereas in the case of non-input of image data, the present routine ends.

In step 205, on the basis of the inputted image data, selection data is generated and is successively outputted to the shift register array 38. The selection data outputted to the shift register array 38 are successively transferred by the plural shift registers 42 which are connected in series, and are held in the corresponding latches 40, and are thereby inputted to the selectors 46 of the corresponding driving signal voltage generating sections 44.

In step 206, the respective compressed driving data for a large droplet, for a medium droplet, for a small droplet, and for non-eject, which are stored in the compressed driving data for a large droplet memory 30A, the compressed driving data for a medium droplet memory 30B, the compressed driving data for a small droplet memory 30C, and the compressed driving data for non-eject memory 30D, are read out at timings which are synchronous with predetermined clock signals, and by generating driving waveforms for a large droplet, for a medium droplet, for a small droplet, and for non-eject, the compressed driving data are decompressed.

In next step 210, the driving waveforms for a large droplet, for a medium droplet, for a small droplet and for non-eject, which were generated by being decompressed in above step 206, are transferred to the respectively corresponding shift register groups 34A, 34B, 34C, and 34D at timings which are synchronous with predetermined clock signals.

The driving waveforms for a large droplet, for a medium droplet, for a small droplet, and for non-eject, which were transferred to the shift register groups 34A, 34B, 34C, and 34D by the processing of step 210, are transferred by the respective shift registers of the shift register groups 34A, 34B, 34C, and 34D, and are outputted to the corresponding driving signal voltage generating sections 44 at timings which are respectively offset from one another by one period of the predetermined clock signal each.

Figure 8:
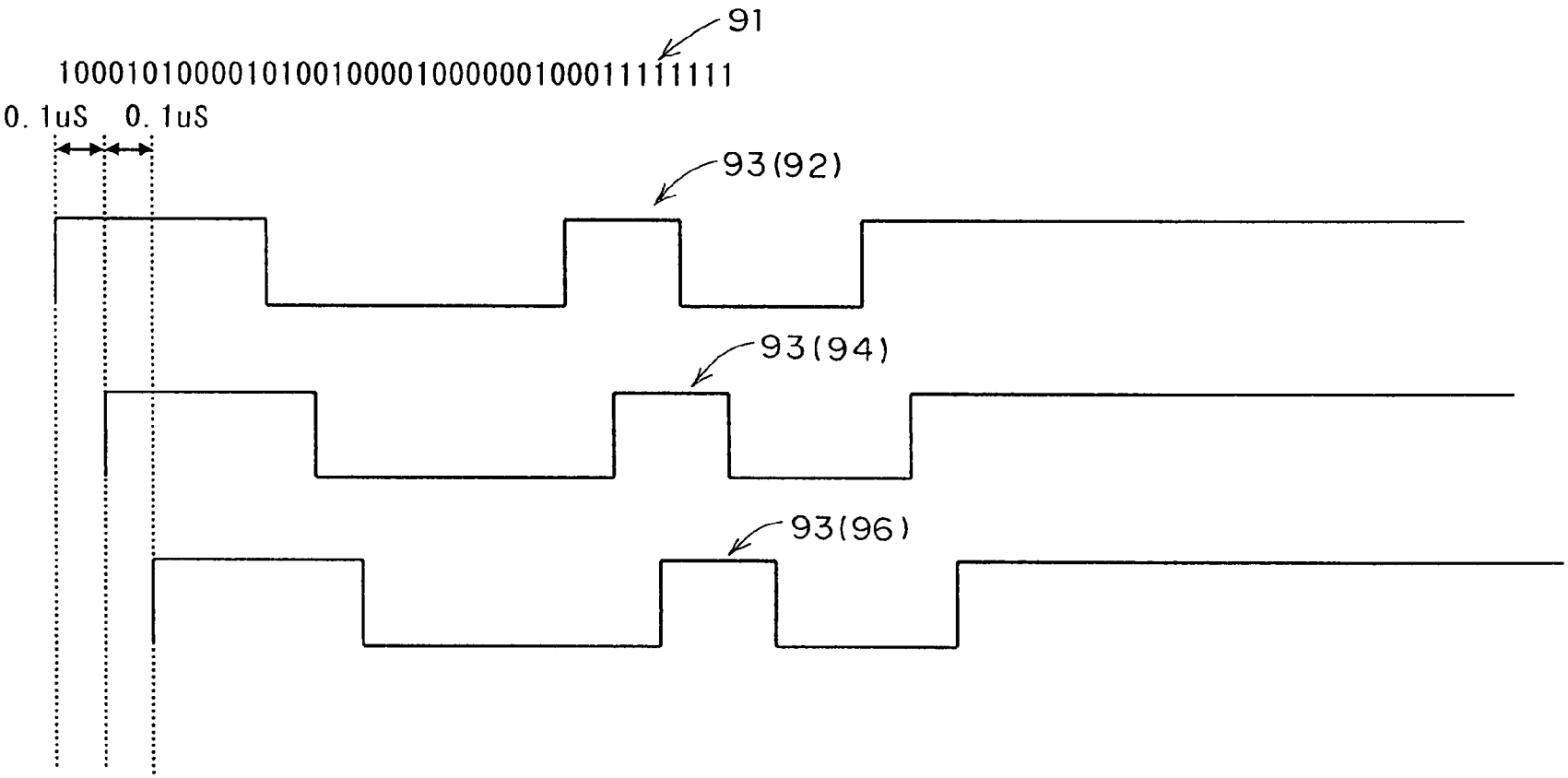
FIG. 8 is a schematic diagram showing an example of compressed data and a driving waveform transferred to the head driving section.

Due to the processings of step 206 and step 210, for example, at a point 90 shown in FIG. 4, the signal which is compressed driving data 91 shown in FIG. 8 is decompressed by the decompression circuit 32C, and in this way, at point 92 (see FIG. 4), is successively transferred through the shift register group 34C as driving waveform 93 for a small droplet, and is transferred to point 94 (see FIG. 4) at a delay of 0.1 μS from point 92 (see FIG. 4), and is transferred to point 96 (see FIG. 4) at a delay of 0.1 μS from point 94 (see FIG. 4).

In next step 212, at the selector 46 at each of the driving signal voltage generating sections 44, the driving waveform, for which selection is instructed by the selection data inputted from the selection data inputting circuit 28 via the corresponding latch 40, is selected from among the inputted driving waveforms for a large droplet, for a medium droplet, for a small droplet, and for non-eject. After the selected driving waveform is outputted to the corresponding piezo element $\mathbf{20}_{1-n}$ via the voltage boosting circuit 48 and the driver circuit 49, the present routine ends.

As described above, in accordance with the image recording apparatus 50 of the present invention, driving waveforms for a large droplet, for a medium droplet, for a small droplet, and for non-eject are each converted into compressed driving data which is a digital signal which expresses, by binary numbers, the voltage level of each period (window) between a time of change and a time of change of the voltage level of the driving waveform, and the duration period of each window, and the compressed driving data can be transferred serially to the head driving section 24. Therefore, it is possible to use a single signal wire for transferring the driving waveforms to the head driving section 24. Thus, it is possible to keep the image recording apparatus 50 from becoming large.

When the driving waveform is adjusted, such as in a case in which the driving waveform must be adjusted in accordance with the temperature or the humidity of the environment in which the image recording apparatus 50 is used or the like, compressed driving data which is generated on the basis of the driving waveform can be serially transferred to the head driving section 24. Therefore, the compressed driving data can be efficiently transferred to the head driving section 24.

Further, at the head driving section 24, the driving waveform can be stored, not as a waveform, but rather, as compressed driving data which is a digital signal expressing, by binary numbers, the voltage level of each period (window) between a time of change and a time of change of the voltage level of the driving waveform, and the duration period of each window. Therefore, the capacity of the memory 30 of the head driving section 24 can be reduced, and it is possible to keep the head driving section 24 from becoming large and the image recording apparatus 50 from becoming large.

Moreover, the driving waveforms are generated by decompressing the compressed driving data, and the generated driving waveforms can be transferred by the shift registers. Thus, there is no need to provide, at the head driving section 24, a special memory for storing the generated driving waveforms, and the head driving section 24 can be kept from becoming large.

Namely, a first aspect of the present invention is a liquid droplet ejecting head comprising: a nozzle; a driving element driving the nozzle and causing a liquid droplet to be ejected from the nozzle; a storing unit respectively storing plural driving waveforms, which are for timewise driving the driving element in accordance with an amount of a liquid droplet, as plural binary digital signals each expressing a voltage level of the driving waveform and a duration time of the voltage level; a driving waveform generating unit generating plural driving waveforms on the basis of the plural digital signals stored in the storing unit; and a supplying unit which, on the basis of image data, selects a driving waveform to be supplied to the driving element from the plural driving waveforms generated by the driving waveform generating unit, and supplies a selected driving waveform to the driving element.

The storing unit of the liquid droplet ejecting head of the first aspect of the present invention respectively stores plural driving waveforms, which are for timewise driving the driving element in accordance with an amount of a liquid droplet, as plural binary digital signals each expressing a voltage level of the driving waveform and a duration time of the voltage level. The driving waveform generating unit generates driving waveforms on the basis of the plural digital signals stored in the storing unit. On the basis of inputted image data, the supplying unit selects a driving waveform to be supplied to the driving element from among the plural driving waveforms generated by the driving waveform generating unit, and supplies the selected driving waveform to the driving element. A liquid droplet is ejected from the nozzle due to the driving element being driven in accordance with the supplied driving waveform.

In the above-described first aspect, the plural driving waveforms are respectively stored as the plural binary digital signals expressing the voltage level of the driving waveform and the duration period of the voltage level. On the basis of the digital signal, a driving waveform is generated and supplied to the driving element. Thus, the capacity of the storing unit can be reduced, and the liquid droplet ejecting head can be kept from becoming large.

The liquid droplet ejecting head of the first aspect may have: an input section to which the plural driving waveforms are inputted; and a converting section converting the plural driving waveforms inputted to the input section into the digital signals, and supplying the digital signals to the storing unit. In accordance with this structure, plural driving waveforms which are inputted from the exterior can be converted into digital signals and stored. Thus, the digital signals which are stored in the storing unit can be updated as occasion demands.

The liquid droplet ejecting head of the first aspect may have an input section to which the digital signals are inputted and which supplies the digital signals to the storing unit. In accordance with this structure, a binary digital signal, which expresses the voltage level of a driving waveform and the duration period of the voltage level, can be inputted and stored in the storing unit. Therefore, the digital signals stored in the storing unit can be updated efficiently.

A second aspect of the present invention is an image recording apparatus comprising a liquid droplet ejecting head which includes: a nozzle; a driving element driving the nozzle and causing a liquid droplet to be ejected from the nozzle; a storing unit respectively storing plural driving waveforms, which are for timewise driving the driving element in accordance with an amount of a liquid droplet, as plural binary digital signals each expressing a voltage level of the driving waveform and a duration time of the voltage level; a driving waveform generating unit generating plural driving waveforms on the basis of the plural digital signals stored in the storing unit; and a supplying unit which, on the basis of image data, selects a driving waveform to be supplied to the driving element from the plural driving waveforms generated by the driving waveform generating unit, and supplies a selected driving waveform to the driving element. In accordance with this structure, the image recording apparatus can be made to be more compact.

The image recording apparatus of the second aspect of the present invention may be provided with: an input section to which the digital signals are inputted and which supplies the digital signals to the storing unit; a converting section converting the plural driving waveforms into the digital signals respectively; and a control section effecting control such that the digital signals converted by the converting section are serially inputted to the input section. In accordance with this structure, control can be carried out such that plural digital signals are serially inputted to the storing unit of the liquid droplet ejecting head. Thus, the number of signal wires inputting digital signals to the liquid droplet ejecting head can be made to be small, the plural driving waveforms can be efficiently supplied to the liquid droplet ejecting head, and the liquid droplet ejecting head and the image recording apparatus can be kept from becoming large.

A third aspect of the present invention is a method of ejecting a liquid droplet comprising: respectively storing plural driving waveforms, which are for timewise driving a driving element in accordance with an amount of a liquid droplet, as plural binary digital signals each expressing a voltage level of the driving waveform and a duration time of the voltage level; generating plural driving waveforms on the basis of the plural digital signals which are stored; and on the basis of image data, selecting a driving waveform to be supplied to the driving element from the plural driving waveforms which are generated, and supplying a selected driving waveform to the driving element.

In the third aspect, the liquid droplet ejecting head can be kept from becoming large.

A fourth aspect of the present invention is an image recording method of recording an image by liquid droplet eject, the method comprising: respectively converting plural driving waveforms, which are for timewise driving a driving element in accordance with an amount of a liquid droplet, into plural binary digital signals each expressing a voltage level of the driving waveform and a duration time of the voltage level; storing the plural digital signals which are converted; generating plural driving waveforms on the basis of the plural digital signals which are stored; and on the basis of image data, selecting a driving waveform to be supplied to the driving element from the plural driving waveforms which are generated, and supplying a selected driving waveform to the driving element.

In the fourth aspect, the image recording apparatus can be kept from becoming large.

As described above, in accordance with the liquid droplet ejecting head of the present invention, plural driving waveforms are stored as binary digital signals expressing the voltage level of the driving waveform and the duration time of the voltage level. On the basis of the digital signal, a driving waveform is generated and is supplied to the driving element. Therefore, there is the effect that the liquid droplet recording head can be kept from becoming large. Moreover, by providing the liquid droplet ejecting head of the present invention at an image recording apparatus, there is the effect that the image recording apparatus can be kept from becoming large.

What is claimed is:

1. A liquid droplet ejecting head comprising:

a nozzle;

a driving element driving the nozzle and causing a liquid droplet to be ejected from the nozzle;

a storing unit respectively storing a plurality of driving waveforms, which are for timewise driving the driving element in accordance with an amount of a liquid droplet, as a plurality of binary digital signals each expressing a voltage level of the driving waveform and a duration time of the voltage level;

a driving waveform generating unit generating a plurality of driving waveforms on the basis of the plurality of digital signals stored in the storing unit; and a supplying unit which, on the basis of image data, selects a driving waveform to be supplied to the driving element from the plurality of driving waveforms generated by the driving waveform generating unit, and supplies a selected driving waveform to the driving element.

2. The liquid droplet ejecting head of claim 1, further comprising:

an input section to which the plurality of driving waveforms are inputted; and a converting section converting the plurality of driving waveforms inputted to the input section into the digital signals, and supplying the digital signals to the storing unit.

3. The liquid droplet ejecting head of claim 1, further comprising an input section to which the digital signals are inputted and which supplies the digital signals to the storing unit.

4. The liquid droplet ejecting head of claim 1, wherein the digital signals are digital signals converted into binary numbers which express the voltage level and the duration time of the voltage level and which are continuous in time series.

5. The liquid droplet ejecting head of claim 1, wherein the digital signals are digital signals converted into binary numbers, whose leading bit expresses the voltage level and whose following portion expresses the duration time of the voltage level.

6. An image recording apparatus comprising a liquid droplet ejecting head which includes:

a nozzle;

a driving element driving the nozzle and causing a liquid droplet to be ejected from the nozzle;

a storing unit respectively storing a plurality of driving waveforms, which are for timewise driving the driving element in accordance with an amount of a liquid droplet, as a plurality of binary digital signals each expressing a voltage level of the driving waveform and a duration time of the voltage level;

a driving waveform generating unit generating a plurality of driving waveforms on the basis of the plurality of digital signals stored in the storing unit; and a supplying unit which, on the basis of image data, selects a driving waveform to be supplied to the driving element from the plurality of driving waveforms generated by the driving waveform generating unit, and supplies a selected driving waveform to the driving element.

7. The image recording apparatus of claim 6, further comprising an input section to which the digital signals are inputted and which supplies the digital signals to the storing unit.

8. The image recording apparatus of claim 7, further comprising:

a converting section converting the plurality of driving waveforms into the digital signals respectively; and a control section effecting control such that the digital signals converted by the converting section are serially inputted to the input section.

9. A method of ejecting a liquid droplet comprising:

respectively storing a plurality of driving waveforms, which are for timewise driving a driving element in accordance with an amount of a liquid droplet, as a plurality of binary digital signals each expressing a voltage level of the driving waveform and a duration time of the voltage level;

generating a plurality of driving waveforms on the basis of the plurality of digital signals which are stored; and on the basis of image data, selecting a driving waveform to be supplied to the driving element from the plurality of driving waveforms which are generated, and supplying a selected driving waveform to the driving element.

10. The method of ejecting a liquid droplet of claim 9, further comprising:

receiving the plurality of driving waveforms; and converting the plurality of driving waveforms which are received into the digital signals respectively.

11. The method of ejecting a liquid droplet of claim 9, further comprising receiving the digital signals.

12. The method of ejecting a liquid droplet of claim 9, wherein the digital signals are digital signals converted into binary numbers which express the voltage level and the duration time of the voltage level and which are continuous in time series.

13. The method of ejecting a liquid droplet of claim 9, wherein the digital signals are digital signals converted into binary numbers, whose leading bit expresses the voltage level and whose following portion expresses the duration time of the voltage level.

14. An image recording method of recording an image by liquid droplet eject, the method comprising:

respectively converting a plurality of driving waveforms, which are for timewise driving a driving element in accordance with an amount of a liquid droplet, into a plurality of binary digital signals each expressing a voltage level of the driving waveform and a duration time of the voltage level;

storing the plurality of digital signals which are converted;

generating a plurality of driving waveforms on the basis of the plurality of digital signals which are stored; and on the basis of image data, selecting a driving waveform to be supplied to the driving element from the plurality of driving waveforms which are generated, and supplying a selected driving waveform to the driving element.

15. The image recording method of claim 14, wherein the digital signals are digital signals converted into binary numbers which express the voltage level and the duration time of the voltage level and which are continuous in time series.

16. The image recording method of claim 14, wherein the digital signals are digital signals converted into binary numbers, whose leading bit expresses the voltage level and whose following portion expresses the duration time of the voltage level.

* * * * *